United States Patent [19]

Bass et al.

[11] 4,364,432

[45] Dec. 21, 1982

[54] SEAL ASSEMBLY

[75] Inventors: C. Joe Bass, Harris County, Tex.; Elmer R. Peterson, Anaheim, Calif.

[73] Assignee: Hughes Tool Company, Houston, Tex.

[21] Appl. No.: 187,383

[22] Filed: Sep. 15, 1980

[51] Int. Cl.[3] ..... E21B 23/04; E21B 33/14

[52] U.S. Cl. ..... 166/290; 166/123; 166/208; 166/387

[58] Field of Search ..... 166/290, 182, 208, 123, 166/125, 382, 383, 387

[56] References Cited

U.S. PATENT DOCUMENTS 3,342,268 9/1967 Brown ..... 166/124
3,910,349 10/1975 Brown ..... 166/208
3,920,075 11/1975 Braddick ..... 166/208
3,934,652 1/1976 Cochran ..... 166/208
4,019,579 4/1977 Thuse ..... 166/182

*Primary Examiner*—Ernest R. Purser
*Assistant Examiner*—Thuy M. Bui
*Attorney, Agent, or Firm*—Robert A. Felsman; Charles D. Gunter, Jr.

[57] ABSTRACT

Disclosed is apparatus for sealing between two concentric annular surfaces whereby the sealing engagement may be disrupted in response to an excess pressure differential acting on the sealing apparatus in one axial direction sense. Elastic means restore the apparatus to its sealing configuration upon reduction of the pressure differential. Apparatus and method disclosed are particularly applicable to cementing liners in wells.

22 Claims, 8 Drawing Figures

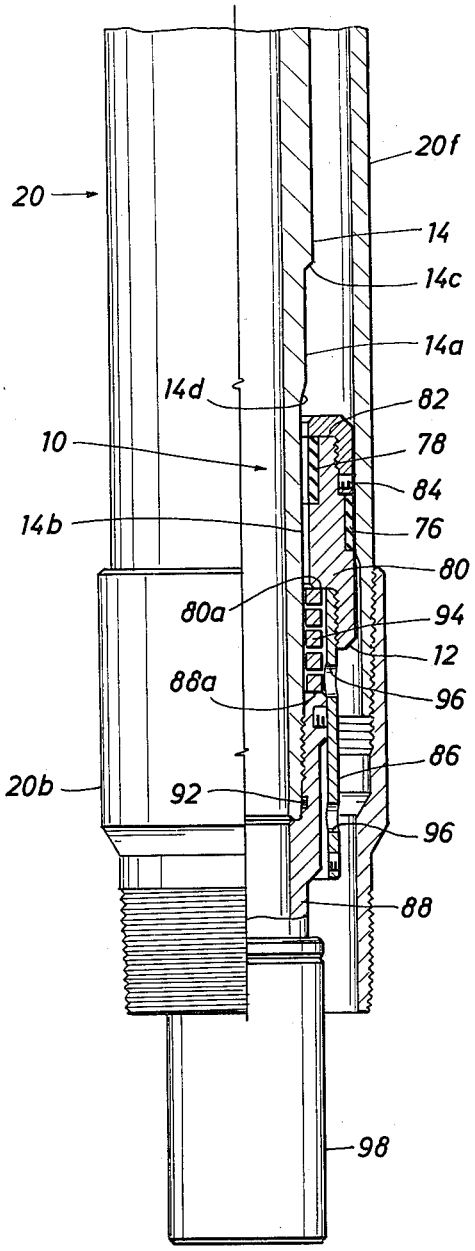
FIG. 4
FIG. 5
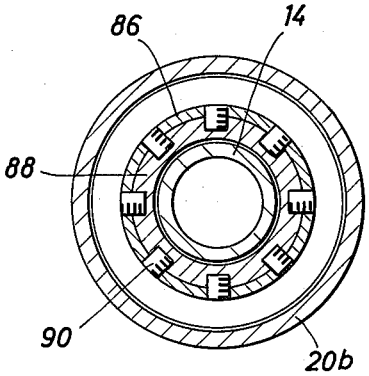

SEAL ASSEMBLY

BACKGROUND OF THE INVENTION

I. Field of the Invention

This invention pertains to techniques for sealing concentric annular surfaces. More particularly, this invention relates to methods and apparatus for cementing liners in wells, and specifically for sealing such liners to pipe strings used to circulate fluid into the well bore during the cementing procedure.

II. Description of Prior Art

The practice of cementing tubing in well bores is well known. Sections of casing may be positioned and cemented in place from the surface as the drilling of the well progresses. Thereafter, for example, a liner may be lowered into a well suspended by a pipe string and positioned to overlap the casing or a previously cemented liner. The liner is anchored in place, usually on slips, and the setting tool by which the liner is suspended from the pipe string is released. Cement is then pumped through the pipe string to the liner, and displaced through the liner, usually through a foot valve, into the annular space between the liner and the surrounding casing or well bore. Plugs are used to separate the cement from displacing fluid, and to wipe the cement from the operating string and the liner.

In such cementing operations, it is necessary to provide a seal in the annular space between the setting tool extension of the pipe string and the surrounding liner so that fluid pressure may be maintained in the operating string during the cementing operation. Inverted swab cup type seal assemblies mounted on the setting tool mandrel for sealing engagement with the surrounding liner have been used for this purpose. The swab cups are removed with the setting tool after the liner has been cemented in place. Annular seals mounted on the interior of the liner for sealing engagement with the setting tool mandrel have also been used. Generally, such liner-mounted seals must be drilled out after the cementing operation since the seals would otherwise partially obstruct the passage through the interior of the liner. Seal assemblies have also been designed which are locked to the liner during the cementing operation, but may be released and retrieved by means of the setting tool.

Since the primary purpose of such setting tool-to-liner seal systems is to permit the establishment of sufficient pressure within the operating string to circulate the cementing fluid, such seal assemblies are particularly designed to withstand pressure differentials from below. However, if the level to which the cement is placed outside of the liner is sufficiently high relative to the seal assembly, a substantial pressure differential from above the seal assembly may develop. In such event, if the pressure differential cannot be relieved, it may be difficult to remove the seal assembly with the mandrel. It is therefore desirable to provide a means for permitting fluid pressure to bypass the seal assembly so that the seal assembly and setting tool may be removed from the well.

Additionally, during the cementing operation, if insufficient fluid is circulated into the well, an unbalanced fluid pressure may be exerted on the seal assembly from above. If the pressure differential is reduced by the opening of a bypass around the seal assembly, the sealing between the setting tool and the liner must be re-established so that the cementing operation may continue. Therefore it is desirable to provide a seal assembly permitting such fluid pressure communication with means whereby the bypass may again be closed and the liner sealed to the mandrel to withstand a pressure differential from below.

SUMMARY OF THE INVENTION

The present invention provides apparatus for sealing between two concentric annular surfaces, such as the interior of a conduit and the exterior of a tubular member positioned within the conduit. A seal body may be positioned between the two annular surfaces. A first set of cooperating sealing members, including an annular seal and an annular seat, are provided on the seal body and the conduit. A second set of cooperating sealing members, including a second annular seal and a second annular seat, are provided on the seal body and the tubular member. In a particular embodiment disclosed, the first and second annular seals are both carried by the seal body, and the first and second seating surfaces are part of the conduit and tubular member respectively.

The seal body is maintained fixed against axial movement relative to at least one of the surfaces, for example the surface of the tubular member. Releasable lock apparatus is provided to so anchor the seal body, and to release the seal body for axial movement in response to force acting on the seal body to move the seal body in one axial sense. The locking apparatus, which comprises shear screws in the embodiment disclosed, anchors the seal body in a first configuration in which both annular seals engage the corresponding seating surfaces. When axial force acts on the seal body, such as in the case of a pressure differential acting on the seal body in a first axial direction sense, to release the locking apparatus and move the seal body out of the first configuration, at least one of the annular seals disengages from the corresponding seating surface and the tubular member is no longer sealed to the conduit. Consequently, with the seal body in a second configuration, a fluid bypass is provided whereby the pressure differential may be reduced, for example. Elastic apparatus is provided to return the seal body to the first configuration, in which both annular seals engage the corresponding annular seats. In the embodiment disclosed, the elastic apparatus includes a coil spring positioned to be compressed between the seal body and the tubular member upon movement of the seal body in the first axial direction sense.

The present invention provides a seal assembly for use in cementing liners in wells. The seal assembly includes a body carrying first and second annular seals for sealing the interior of the liner to a pipe string extending into the liner. The pipe string features a first portion acting as a seating surface for the second annular seal, and a second portion axially displaced from and of lesser outer diameter than the first portion. When the seal body is in a first configuration, the second annular seal is in sealing engagement with the pipe string first portion seating surface; when the seal body is moved to a second configuration, the second annular seal is moved out of sealing engagement with the pipe string seating surface and is in registration with the second portion of the pipe string. In the latter configuration, fluid may communicate along the annular region between the pipe string and the liner by the seal body. The pipe string second portion thus serves as a bypass profile relative to the seal body.

The seal body is mounted on the pipe string for limited axial movement relative to the pipe string between the first configuration and the second configuration. Releasable lock means, in the form of shear screws, anchor the seal body in the first configuration until sufficient pressure differential acts on the seal body from above to cause the shear screws to break. Elastic apparatus, in the form of a coil spring, is then compressed between the seal body and the pipe string as the seal body is moved out of the first configuration under the influence of the pressure differential to open the bypass passage. Once the pressure differential has been relieved by fluid pressure communication along the bypass profile, the coil spring may return the seal body to the first configuration in which the second annular seal sealingly engages the pipe string seating surface.

In a method of the invention a liner may be cemented in a well by positioning the liner in the well bore by means of a setting tool suspended from a pipe string and extending into the liner, with the pipe string sealed to the liner by means of a seal assembly mounted on the setting tool extension. The liner is anchored in the well bore and the setting tool is released from the liner. Fluid may be appropriately circulated into the well bore through the liner to position the cement in the annular region between the liner and the well bore wall. Throughout the cementing operation the seal assembly is permitted to disengage from sealing between the setting tool and the liner in response to excessive pressure differential acting on the seal assembly from above. Upon the reduction of such pressure differential, the seal assembly is again closed to re-establish sealing between the setting tool extension and the liner. The setting tool and the seal assembly are withdrawn from the well upon completion of the circulation of fluid to cement the liner in the well bore, with the seal assembly opening the sealing between the setting tool extension and the liner in response to any excessive pressure differential acting on the seal assembly from above.

The value of pressure differential acting on the seal body which will cause the seal body to move out of its first configuration to open the fluid bypass between the pipe string and the liner may be predetermined by releasably locking the seal body to the setting tool by frangible members which will shear upon application of specific force values. Thus, any pressure differential acting from above on the seal body in value less than the predetermined value will not be sufficient to break the frangible members. Consequently, the seal body will unseat only in response to pressure differentials of value equal to or greater than the predetermined value.

The present invention provides a retrievable stuffing box, or seal assembly, for use in cementing liners in wells, for example. The stuffing box is mounted on the setting tool which is supported by the pipe string and extends into the interior of the liner, and is retrievable with the pipe string and setting tool upon completion of the cementing procedure. In the event that a downward pressure differential acts on the seal assembly at the completion of the cementing operation to inhibit removal of the seal assembly with the setting tool, the seal assembly will be opened by the pressure differential itself to permit fluid communication by the seal assembly in the annular region between the setting tool and the liner to reduce the pressure differential. Then, the setting tool and seal assembly may be removed without difficulty. Should such a pressure differential occur before or during the cementing process, the stuffing box will release, then reseal the annular region between the setting tool and the liner after the pressure differential has been sufficiently reduced. Consequently, the cementing procedure may continue uninterrupted.

BRIEF DESCRIPTION OF THE DRAWINGS

FIG. 4 is a view similar to FIG. 3B but showing the seal assembly in bypass configuration; and FIG. 5 is a horizontal cross section taken along line 5—5 of FIG. 3B.

DESCRIPTION OF PREFERRED EMBODIMENT

Figure 1A:
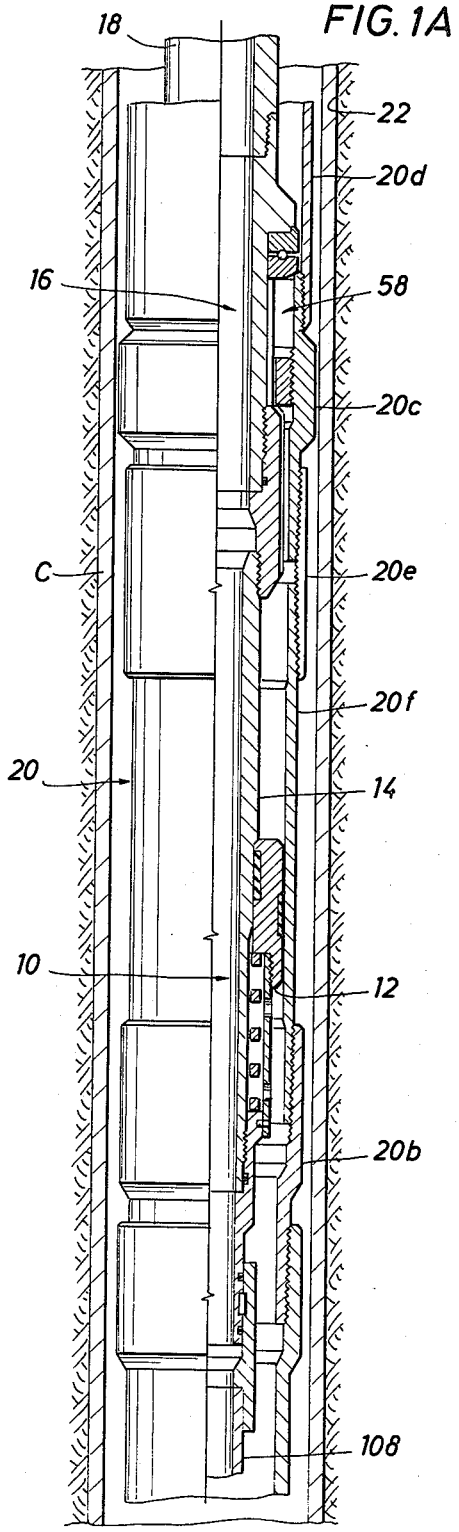
FIGS. 1A and 1B together are an elevation in partial section illustrating a setting tool, a liner and a seal assembly according to the present invention, along with associated equipment positioned in a well in which the liner is to be cemented, with FIG. 1A showing the upper portion of the apparatus, and FIG. 1B showing the lower portion.

A seal assembly according to the present invention is illustrated in FIGS. 1A–5 with associated apparatus for cementing liners in wells. It will be appreciated from the foregoing and the following description that the seal assembly of the present invention is not limited to such applications but may be employed in virtually any environment in which radially spaced concentric annular surfaces are to be sealed.

The seal assembly shown generally at 10 in FIGS. 1A, 2A, 3B and 4 includes a seal body 12 mounted on a tubular member, or mandrel, 14 which, in the context of liner cementing apparatus, is part of a setting tool shown generally at 16. The setting tool 16 is suspended from a pipe string 18 which extends from the surface and serves as an operating string for the cementing process.

The setting tool mandrel 14 and the seal body 12 are positioned within a liner, shown generally at 20, which is to be cemented within a well bore 22. The liner 20 generally includes one or more conduit or tubular members **20*a* and collars such as 20*b*. The liner 20 includes a setting sleeve 20*c* by which the liner is initially suspended from the pipe string 18, as discussed in more detail hereinafter, and typically ends in a tie-back sleeve 20*d* extending upwardly from the setting sleeve. The setting sleeve 20*c* is connected by a collar 20*e* to a polished bore receptacle (PBR) 20*f*, which also forms part of the liner and is joined to the collar 20*b***.

A landing section 24 is included in the liner 20 toward its bottom end. The landing section 24 features a seat and latch engaging profile 26 for a purpose discussed hereinafter. The liner 20 ends in a cementing shoe 28 which is provided with a back pressure or check valve 30 which permits passage of cement B from within the liner through ports 32 in the shoe into the annular area A surrounding the liner. The valve 30 closes in response to any tendency of fluid to flow back into the liner.

The liner 20 may be fitted with a liner hanger, shown schematically at 34, which includes a plurality of slips 36 and setting cones 38 by which the liner is supported in the well bore. The construction and operation of such liner hanger 34 are well known and will not be described in detail herein.

The well bore 22 may be partially lined with casing C cemented in place. When cemented in place, the liner 20 serves to continue the lining of the bore 22 below the casing C. The liner 20 is positioned by manipulation of the operating string so that the liner hanger 34 may engage the casing C to support the liner 20 while the latter is being cemented in place.

Figure 1B:
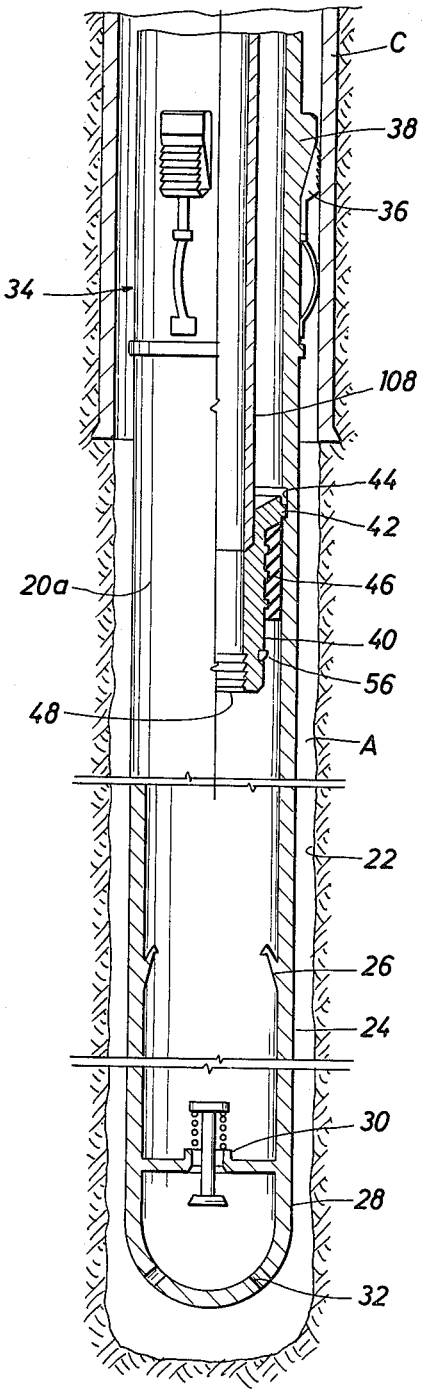

A tubular liner wiper plug 40 may be releasably disposed within the liner string 20 near the lower end of the setting tool mandrel 14 in the running-in and cementing configurations (FIGS. 1A and 1B). The central passage of the plug 40 may be engaged by the lower end of the mandrel 14 and aligned with its central passage. The liner wiper plug 40 may be held in the position shown in FIGS. 1B by a frangible projection 42 received in an annular recess 44 provided in the liner 20 for that purpose. In the alternative, the liner wiper plug 40 may be releasably joined to the bottom of the setting tool mandrel 14. A resilient seal member 46 is carried by the body of the liner wiper plug 40 and maintains sealing engagement between the plug and the interior surface of the liner 20. The central passage through the liner wiper plug 40 may feature a frictionally engagable surface portion such as annular, downwardly directed teeth 48 as shown.

Figure 2A:
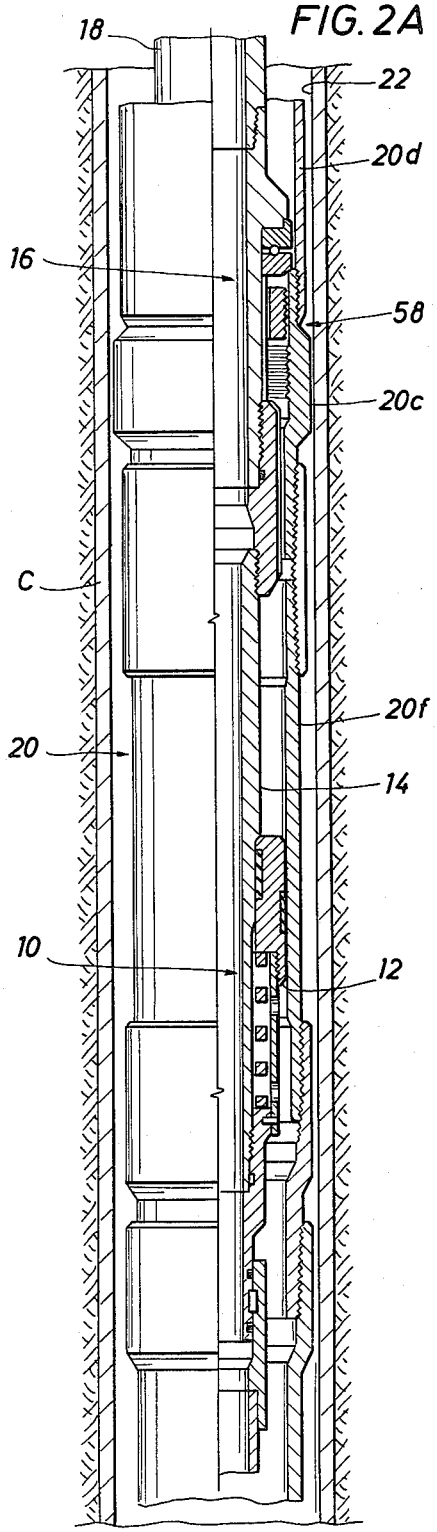
FIGS. 2A and 2B combined form a view similar to FIGS. 1A and 1B combined, but illustrating the apparatus after the cement has been placed.
Figure 2B:
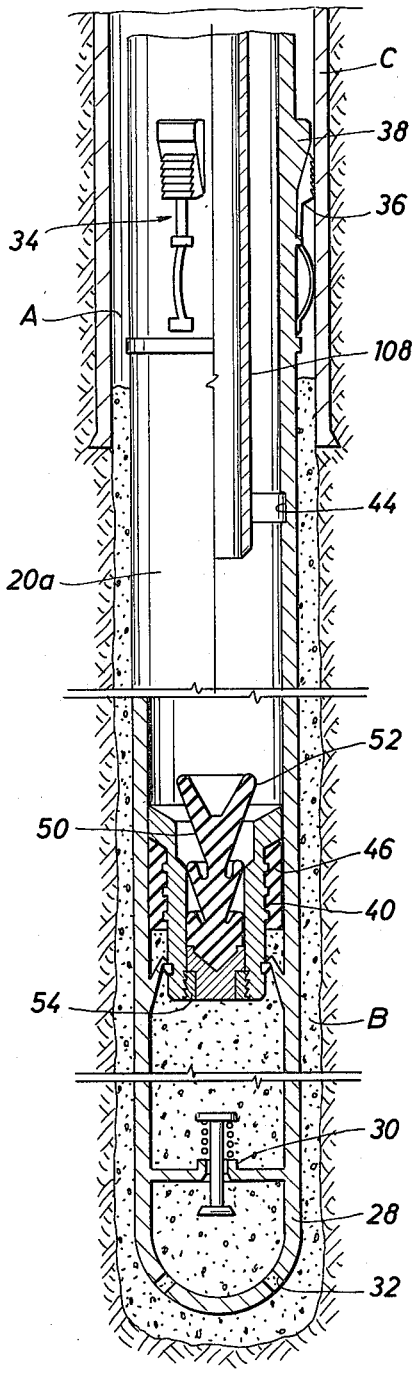

As indicated in FIG. 2B, a pumpdown plug 50 may be utilized. Such a pumpdown plug 50 may be provided with lip-type seals 52 for sliding and sealing engagement with the interior of the operating string 18 and the mandrel 14. The pumpdown plug 50 is also sized and adapted to engage the central opening of the liner wiper plug 40, and includes a latching device such as slips 54 for frictional engagement with the teeth 48 of the liner wiper plug. When the pumpdown plug 50 is locked to the liner wiper plug 40 by the slips 54 as shown in FIG. 2B, the seals 52 engage the interior or surface of the plug 50 to provide sealing engagement between the two plugs.

After the cement B has been introduced into the operating string 18, additional fluid is introduced into the well to force the cement to circulate down through the liner 20, out of the landing section 24 and into the annular area A. The pumpdown plug 50 is inserted into the operating string 18 to separate the additional pumping fluid from the cement. As it is thus circulated with the fluid, the pumpdown plug 50 cleans the cement from the interior of the operating string 18. When the pumpdown plug 50 reaches the liner wiper plug 40, the two plugs engage and lock together by means of the slips 54 locking with the annular teeth 48. Downward pressure caused by further pumping at the surface is transmitted to the liner wiper plug 40 so that the frangible projection 42 breaks, releasing the two plugs to be pumped downwardly through the liner 20 as a unit. During such passage of the combination of plugs 40 and 50 through the liner 20, the seals 52 of the pumpdown plug 50 engage the interior surface of the liner wiper plug 40, and the seal member 46 sweeps cement from the interior surface of the liner members so that separation of the cement from the pumping fluid by the plugs 40 and 50 is maintained.

The liner wiper plug 40 also carries in an appropriate groove a snap ring 56 which engages with the profile 26 of the landing section 24 to lock the combination of plugs 40 and 50 in place toward the bottom of the liner 20. With the plugs 40 and 50 thus secured against upward movement relative to the liner 20, the seals 46 and 52 prevent upward flow of cement in the liner 20 in addition to the functioning of the check valve 30.

The liner string 20 is initially attached to and supported by the operating string 18 by means of a rotating connector, shown generally at 58, between the setting sleeve **20*c* and the setting tool 16. Details of the connector 58 may be appreciated by reference to FIG. 3A wherein a left-handed threaded nut 60 is shown engaging coarse left-hand threads 62 on the interior of the setting sleeve 20*c*. The interior of the nut 60 is provided with one or more longitudinal slots 60*a* for engagement with corresponding splines 64 on the setting tool 16. In the running-in configuration of FIG. 3A, the weight of the liner 20 may be supported by the nut 60 threadedly engaged to the setting sleeve 20*c* and supported by a shoulder 66*a* provided by a collar 66 forming part of the setting tool 16. The collar 66 is sealed by an O-ring seal 67 to maintain fluid tight integrity of the setting tool 16**.

The upper portion of the setting tool 16 is provided with an annular shoulder 68 against which an upper race 70 is fitted. A lower race 72 rests on the upper extension of the setting sleeve **20*c*, and cooperates with the upper race 70 to constrain a plurality of bearing members 74 to permit rotation of the operating string 18 and the setting tool 16 with respect to the liner string 20 with the latter anchored to the casing C by the liner hanger 34. Rotation of the setting tool 16 by application of torque to the operating string 18 at the surface in a right-hand sense with respect to the anchored liner string 20 will cause the nut 60 to move upwardly on the splines 64 and to eventually disengage from the threads 62 of the setting sleeve 20*c*. In this manner, the setting tool 16 is released from the liner string 20**.

Figure 3A:
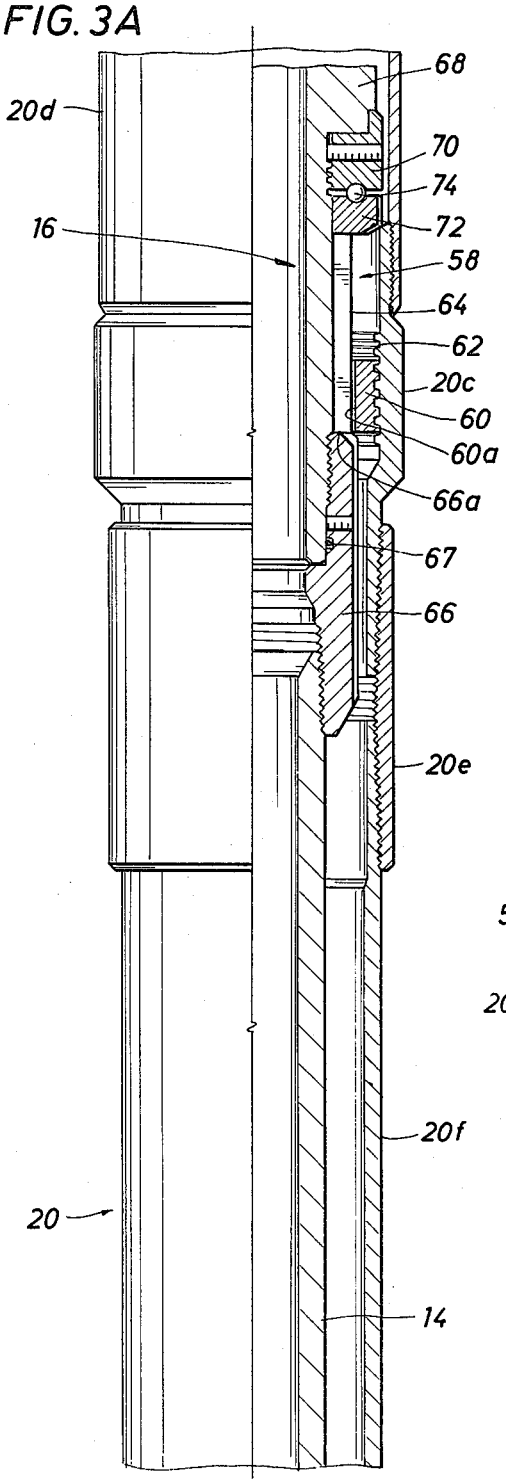
FIGS. 3A and 3B together provide an enlarged elevation in quarter section of the setting tool and seal assembly positioned within the liner in sealing configuration, with FIG. 3A showing the upper portion of the apparatus, and FIG. 3B showing the lower portion.
Figure 3B:
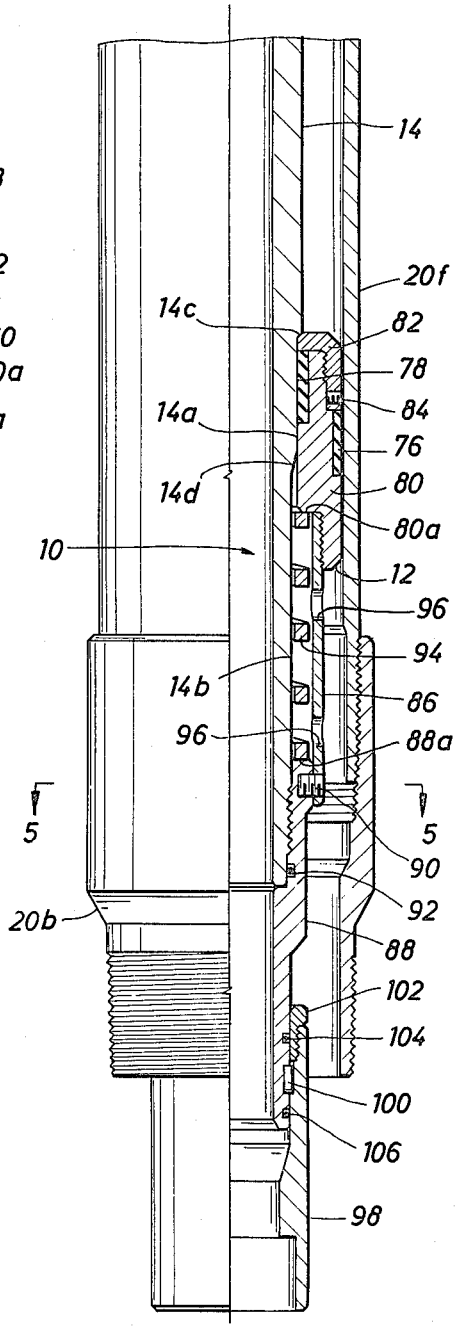

As best seen by reference to FIGS. 3B, 4 and 5, the seal body 12 of the seal assembly 10 is generally tubular, and carries a first, or outer, seal member 76 for sealing and sliding engagement with the interior surface of the PBR **20*f* of the liner 20. The PBR 20*f* thus provides a first annular seating surface for the outer seal 76. The seal body 12 also carries a second, or inner, annular seal member 78 for sealing engagement with a first portion 14*a* of the mandrel 14** serving as a second annular seating surface.

While the details of construction of the seal body may be varied, the annular seals 76 and 78 may be conveniently mounted within appropriate annular recesses formed in a sleeve member 80, and locked in place by a seal retainer ring 82 threaded to the sleeve 80 and locked by at least one set screw 84 as illustrated.

The seal body 12 also includes a downward extension, shown in the form a tubular member 86 threadedly engaged to the sleeve 80. The tubular member 86 is connected to an extension of the mandrel 14 in the form of a swivel member 88 by a plurality of shear screws 90. The swivel member 88 is sealed to the mandrel by an O-ring seal 92 in an appropriate groove, and provides an annular shoulder **88*a*. A second annular shoulder 80*a* is provided by the sleeve 80 of the seal body 12. An annular region is formed between the interior of the tubular member 86 and a second portion 14*b* of the mandrel 14. The mandrel second portion 14*b* is axially displaced from the mandrel first portion 14*a*, and is of lesser outer diameter than the first portion, as illustrated. A coil spring 94 circumscribes the second mandrel portion 14*b* and is constrained under compression in the running-in configuration (FIG. 3B) within the annular region between the second mandrel portion 14*b* and the tubular member 86, and axially between the two annular shoulders 80***a* and 88*a*. The coil spring 94 thus biases the seal body 12 in an upward axial direction sense relative to the mandrel 14.

The axial extent of the mandrel first portion 14*a* is defined by an annular shoulder 14*c* at the upper end of the first portion and a second annular shoulder 14*d* separating the first portion from the second mandrel portion 14*b*. With the shear screws 90 intact, the seal retainer 82 of the seal body 12 may lodge against the upper annular shoulder 14*c* as shown in FIG. 3B. In this configuration, the second annular seal member 78 of the seal assembly 10 is in sealing engagement with the first mandrel portion 14*a*.

Under the influence of downward forces acting on the seal body 12, the shear pins 90 may break, allowing the seal body to be driven downwardly in a first axial direction sense relative to the mandrel 14, further compressing the spring 94 between the annular shoulders 80*a* and 88*a*. As illustrated in FIG. 4, with the seal body 12 thus lowered, the inner seal member 78 is removed from sealing engagement with the first mandrel portion 14*a*, and is in registration with the second mandrel portion 14*b*. Since the second mandrel portion 14*b* is of lesser outer diameter than the seating surface of the first mandrel portion 14*a*, the sealing engagement between the seal body 12 and the mandrel 14 is broken in the configuration of FIG. 4, allowing fluid communication along the annular region between the mandrel and the liner 20 by the seal body 12. The second mandrel portion 14*b* thus serves as a bypass profile to allow such fluid communication.

The tubular member 86 is provided with a plurality of radial ports 96 to allow free fluid flow by the seal body in the bypass configuration of FIG. 4, and also to prevent fluid pressure lock relative to the annular region between the tubular member and the second mandrel portion 14*b* that might otherwise prevent axial movement by the seal body 12.

It will be appreciated that such operation of the seal assembly to open or close sealing engagement between the mandrel 14 and the PBR 20*f* may be effected while the outer annular seal member 76 maintains sealing engagement with the inner surface of the PBR.

The swivel member 88 is part of a swivel assembly including a second swivel member 98 joined to the first swivel member for rotational movement relative thereto by a plurality of roller bearings 100 constrained between appropriate shoulders of the two swivel members and a bearing retainer ring 102 threaded to the top of the second swivel member 98. O-ring seals 104 and 106 seal the two swivel members 88 and 98 together and isolate the roller bearings 100 for lubrication. The mandrel 14 may be continued downwardly from the second swivel member 98 by an extension 108 as shown in FIGS. 1A–2B. The mandrel extension 108 may engage the liner wiper plug 40 in the running-in configuration, while the rotational connection between the swivel members 88 and 98 cooperates with the bearing members 74 to permit rotation of the setting tool 16 relative to the liner 20 without relative axially displacement during disengagement of the rotating connector 58.

In a typical cementing operation, the apparatus is run in the well bore 22 in the configuration illustrated in FIGS. 1A and 1B. The liner string 20 is joined to the operating string 18 by the rotating connector 58, and the liner wiper plug 40 is fixed to the liner near the bottom of the mandrel extension 108 by the frangible projection 42. With the liner 20 positioned at the point of the well bore 22 wherein the liner is to be cemented, the operating string 18 is appropriately manipulated to set the liner hanger 34. Thus, the setting cones are maneuvered under the slips 36 which are thereby moved radially outwardly into gripping engagement with the casing C, complementary beveled surfaces of the cones and slips cooperating to wedge the liner string 20 locked against downward movement relative to the casing. Circulation may be established by pumping circulating fluid down through the operating string 18, the setting tool 16, the liner string 20 and through the shoe 28 into the annular space A surrounding the liner string.

After circulation is established, the setting tool 16 may be released from the liner string 20 by rotation of the operating string 18 in the right-hand sense to release the splined nut 60 as shown in FIG. 2A. The operating string 18 may be lifted a short distance to ensure that this release has been effected.

A properly measured amount of cement B is then pumped into the operating string 18. At this point, the pumpdown plug 50 is placed in the operating string 18 effecting a movable seal behind the cement B as it is pumped through the operating string, the setting tool 16 and the central passage of the liner wiper plug 50 into the liner string 20. A displacing fluid is pumped behind the pumpdown plug 50, forcing the plug 50 into the central passage of the liner wiper plug 40 so that the slips 54 engage the friction surface 48.

Further pressure, induced by pumping the displacing fluid behind the pumpdown plug 50, causes the frangible projection 42 of the liner wiper plug 40 to break, releasing both the pumpdown plug 50 and the liner wiper plug 40 for further movement down the liner string 20. The two plugs 40 and 50 are movable together, upon release of the liner wiper plug 50, to effect a movable seal behind the cement B as the cement is displaced from the liner 20 through the shoe 28 into the annular region A surrounding the liner spring. Upon reaching the landing section 24, the liner wiper plug 40 lands and seats in the latch profile 26 as shown in FIG. 2B. At this point, cement B has been pumped upwardly into the annular space A surrounding the liner string 20 to the desired level as shown.

During the process of circulating the cement B by pumping action at the surface, pressure is maintained within the operating string 18 and the liner string 20 by the sealing connection between the setting tool mandrel 14 and the liner string PBR 20*f* as provided by the seal assembly 10. Generally, throughout such process, a pressure differential may be expected to act upwardly on the seal assembly 10 from below. In such case, the shoulder 14*c* prevents upward movement of the seal body 12 relative to the mandrel 14, and receives force acting on the seal body due to the pressure differential. When necessary, weight may be applied to the operating string 18 at the surface to counter any tendency of the pressure differential to raise the operating string. Thus, forces acting upwardly on the seal body 12 will not effect shearing of the screws 90, since the seal body is locked by the shoulder 14*c* against upward movement relative to the mandrel 14 from the position of the seal body illustrated in FIGS. 1A, 2A and 3B.

Since the seal assembly 10 maintains sealing engagement with the liner string 20 by means of a seating surface formed along the interior of the PBR 20*f*, the operating string 18, with the seal body 12 attached, may be lifted or axially displaced during the circulation of the cement B without interrupting the seal between the setting tool 16 and the liner string. The length of the PBR 20*f* is thus generally available for sliding and sealing engagement of the outer seal member 76 for corresponding axial movement of the operating string 18 relative to the liner 20.

After the cement has been positioned between the liner and the well bore, and the combined plugs 40 and 50 have been pumped and latched into the landing section 24, the operating string 18 may be raised at the surface to withdraw the entire operating string, the setting tool 16 and the seal body 12. Since the seal body 12 is not anchored to the liner string 20, but is carried on the setting tool 16 by the shear screws 90, raising the setting tool with the operating string 18 will raise the seal body as well.

If a result of the cementing process has been to increase the pressure above the liner string 20, a pressure differential may develop which acts downwardly on the seal assembly 10 between the liner and the setting tool 16. Such a downward pressure differential may occur, for example, if the cement B is pumped to too high a level outside the liner string 20. In such cases, it may be difficult to raise the seal body 12 against the pressure differential to remove the seal body with the operating string 18 and the setting tool 16. Then, it is desirable to be able to relieve the impeding pressure differential so that the seal body 12 may be so removed. The shear screw connection 90 is so provided to accomplish this operation.

The number and shear limit of the shear screws 90 are chosen so that the shear screws are all broken in response to a downward pressure differential acting on the seal body 12 of a value sufficient to prevent removal of the seal body. When such a pressure differential develops, the forces acting on the seal body 12 downwardly in a first axial direction sense are transmitted from the sleeve 80, through the tubular member 86, to the shear screws 90 to break the screws and release the seal body for downward movement relative to the mandrel 14. Such downward movement continues until the sealing engagement between the liner string 20 and the mandrel 14 is broken. Thus, the seal body 12 is driven downwardly by the pressure differential until the inner annular seal member 78 slides out of sealing engagement with the first mandrel portion 14*a*, as illustrated in FIG. 4. In the bypass configuration illustrated in FIG. 4, the seal body 12 has been moved in the first axial direction sense until the inner seal member 78 is in registration with the bypass profile 14*b*. Then, the pressure differential may be reduced by fluid pressure communication between the seal body 12 and the bypass profile 14*b*, with the ports 96 accommodating fluid communication through the tubular member 86.

The seal body 12 remains in the bypass configuration of FIG. 4 until the pressure differential across the seal body has been reduced sufficiently that the increased upwardly directed force on the seal body generated by the compressed string 94 exceeds the downwardly directed force acting on the seal body due to the fluid pressure. Then, the spring 94 drives the seal body 12 upwardly to once again achieve the configuration shown in FIG. 3B wherein the seal body is sealed to the mandrel 14 by sealing engagement between the inner seal member 78 and the seating surface 14*a*. With the impeding downwardly-directed pressure differential relieved, the seal body 12 may be raised out of the well with the operating string 18.

It will be appreciated, however, that the seal body 12 may be withdrawn with the setting tool 16 and the operating string 18 while the seal body is still in the bypass configuration of FIG. 4. In the bypass configuration, the seal body 12 may be raised by upward axial movement of the setting tool mandrel 14, with the shoulder 88*a* lifting the spring 94 and the seal body by means of the spring acting upwardly on the shoulder 80*a*. Further, upward movement of the setting tool 16 with the seal body 12 in the bypass configuration may be enhanced, as compared to such upward movement with the seal body in the sealed configuration of FIG. 3B, due to the ability of fluid contained within the liner string 20 to continue to bypass the seal body by flowing between the seal body and the bypass profile 14*b*.

If a downwardly-directed pressure differential occurs during the cementing operating, the shear pins 90 may break as described to permit the pressure differential to drive the seal body 12 downwardly in a first axial direction sense to achieve the bypass configuration of FIG. 4. Such a downward pressure differential may occur, for example, if insufficient fluid is circulated into the well during the cementing operation. The seal body 12 will remain in the bypass configuration to permit reduction of the pressure differential by fluid communication along the bypass profile 14*b*. During the time the seal assembly 10 is held in the bypass configuration, the pressure differential acting downwardly between the liner 20 and the setting tool 16 accommodates the pressure build up necessary to circulate the cement B into place.

When the pressure differential has been sufficiently reduced, the spring 94 will again propel the seal body 12 upwardly to achieve the sealing configuration of FIG. 3B. The circulation of cement B and pumping fluid may continue unabated, with the seal assembly 10 once again providing a sealing engagement between the setting tool mandrel 14 and the liner string 20 to permit a pressure build up below the seal assembly. Thus, in the absence of excessive downward pressure differential on the seal body 12, the sealing engagement of the inner seal member 78 with the seating surface 14*a* of the mandrel 14 may be maintained by virtue of the upward biasing of the seal body 12 by the spring 94 even though the shear screws 90 have been broken.

The present invention provides a seal assembly particularly applicable for effecting operations of cementing liners in wells whereby the seal body of the seal assembly may be removed to leave the liner string without internal obstructions after the cementing operation has been completed. Additionally, the present invention provides a seal assembly which permits release of the sealing engagement between the setting tool and the liner string in the presence of pressure differentials acting downwardly on the seal assembly to otherwise impede the removal of the seal body. Further, the present invention provides for disengagement of the sealing between the setting tool and the liner string in the presence of excessive downward pressure differentials during the cementing operation, and the re-establishment of sealing engagement between the setting tool and the liner once such pressure differentials have been reduced whereby the cementing operation may be continued without interruption, the pressure differential itself effectively preventing upward flow of cement between the liner and the setting tool beyond the seal body when the latter is in its bypass configuration.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Apparatus for sealing between two concentric annular surfaces comprising:

(a) a generally tubular seal body for positioning between such two annular surfaces;

(b) first annular seal means carried by said seal body for sealing engagement with the outer annular surface;

(c) second annular seal means carried by said seal body for sealing engagement with the inner annular surface;

(d) releasable lock means for maintaining said seal body fixed relative to at least one of said annular surfaces, said lock means releasing said seal body for axial movement relative to said annular surface in a first sense in response to fluid pressure differential acting on said first and second seal means in said first axial direction sense; and (e) elastic means for biasing said seal body in the opposite sense along said axial direction whereby, when said pressure differential which has moved said seal body in said first axial direction sense is relieved, said elastic means may move said seal body in the opposite axial direction sense.

2. Apparatus for sealing a conduit to a mandrel positioned generally within the conduit comprising:

(a) a seal body for positioning generally between the conduit and the mandrel;

(b) first cooperating seal members as part of said seal body and as part of said conduit whereby, when said seal body is in a first configuration, said seal body sealingly engages said conduit;

(c) second cooperating seal members as part of said seal body and as part of said mandrel whereby, when said seal body is in said first configuration, said seal body sealingly engages said mandrel;

(d) releasable lock means for maintaining said seal body in said first configuration, said lock means releasing said seal body for movement out of said first configuration upon application of force of predetermined value on said seal body in a first axial direction sense;

(e) elastic means for biasing said seal body in the opposite axial direction sense;

(f) whereby, when said seal body is moved out of said first configuration, said seal body disengages from sealing engagement with at least one of said conduit and said mandrel; and (g) whereby, when said seal body is so moved out of said first configuration, said elastic means urges said seal body toward said first configuration.

3. Apparatus as defined in claim 2 wherein said releasable lock means comprises frangible means for anchoring said seal body fixed against axial movement.

4. Apparatus as defined in claim 3 wherein said frangible means comprise a plurality of shear members for connecting said seal body to said mandrel.

5. Apparatus as defined in claim 2 wherein said first cooperating seal members include an annular seal carried by said seal body and an annular seating surface as part of said conduit such that said annular seal may sealingly engage said annular seating surface to so seal said seal body to said conduit.

6. Apparatus as defined in claim 2 wherein said second cooperating seal members include an annular seal carried by said seal body and an annular seating surface as part of said mandrel such that said annular seal may sealingly engage said annular surface to so seal said seal body to said mandrel.

7. Apparatus as defined in claim 6 wherein said mandrel further includes a second annular surface axially displaced from and of lesser diameter than said annular seating surface, whereby, when said seal body is so moved out of said first configuration, said annular seal is in registration with said second annular surface, thereby permitting fluid communication along the exterior of said mandrel by said annular seal.

8. Apparatus as defined in claim 6 wherein said releasable lock means comprises frangible means for anchoring said seal body fixed against axial movement relative to said mandrel.

9. Apparatus as defined in claim 8 wherein said elastic means connects said seal body and said mandrel so that said elastic means is strained upon such movment of said seal body out of said first configuration.

10. Apparatus as defined in claim 2 wherein said elastic means comprises spring means whereby movement of said seal body in said first axial direction sense strains said spring means.

11. Apparatus for cementing liners in wells comprising:

(a) a pipe string for extension into such a liner;

(b) a seal assembly for sealing between the exterior of said pipe string and the interior of said liner, said seal assembly including a generally tubular seal body carrying a first annular seal and a second annular seal;

(c) a first annular seating surface as part of the interior surface of said liner and which the first annular seal may sealingly engage;

(d) a second annular seating surface as part of the exterior surface of said pipe string and which the second annular seal may sealingly engage;

(e) a bypass profile as part of the exterior surface of said pipe string whereby, with said second annular seal in registration with said bypass profile, fluid may communicate axially in the annular region between said pipe string and said liner by said seal assembly;

(f) releasable lock means for maintaining said seal body fixed relative to said pipe string with said second annular seal in sealing engagement with said second annular seating surface, whereby said lock means releases in response to the application of axial force on said seal body in a generally downward direction in such well, and whereby such force may move said seal body so that said second seal is out of sealing engagement with said second seating surface and is in registration with said bypass profile; and (g) elastic means for biasing said seal body axially relative to said pipe string so that, after the release of said lock means in response to such axial force, said elastic means may move said seal body axially relative to said pipe string to reposition said second seal in sealing engagement with said second seating surface.

12. Apparatus as defined in claim 11 wherein said releasable lock means comprises a plurality of shear members for connecting said seal body to said pipe string.

13. Apparatus as defined in claim 11 wherein said elastic means comprises spring means for connecting said seal body and said pipe string whereby, when said seal body is positioned with said second annular seal in registration with said bypass profile, said spring means is strained to so bias said seal body to move to position said second seal in sealing engagement with said second seating surface.

14. Apparatus for cementing liners in wells comprising:

(a) a pipe string for extension into such a liner;

(b) a seal assembly for sealing between the exterior of said pipe string and the interior of said liner, said seal assembly including a generally tubular seal body mounted on said pipe string for limited axial movement between a first configuration and a second configuration relative to said pipe string;

(c) a first annular seal carried by said seal body for sealing said seal body to said liner, and a second annular seal carried by said seal body;

(d) a first portion of said pipe string comprising an annular seating surface, and a second portion of said pipe string axially displaced from and of lesser outer diameter than said first portion, such that, when said seal body is in said first configuration, said second seal is in sealing engagement with said seating surface, and, when said seal body is in said second configuration, said second seal is in registration with said second portion thereby permitting fluid communication axially in the annular region between said seal body and said pipe string; and (e) releasable lock means for anchoring said seal body to said pipe string in said first configuration.

15. Apparatus as defined in claim 14 further comprising elastic means connecting said seal body to said pipe string and for biasing said seal body toward said first configuration.

16. Apparatus as defined in claim 15 wherein said elastic means comprises spring means which is strained when said seal body is moved to said second configuration.

17. Apparatus as defined in claim 14 wherein said lock means comprises at least one shear member connecting said seal body to said pipe string with said seal body in said first configuration, and frangible in response to force acting on said seal body tending to move said seal body out of said first configuration toward said second configuration.

18. A method of cementing liners in wells comprising the following steps:

(a) positioning a liner in a well bore connected to a setting tool suspended from a pipe string and extending into the liner and sealed thereto by a seal assembly mounted on the setting tool;

(b) anchoring the liner in the well bore and releasing the setting tool from the liner;

(c) circulating fluid into the well bore through the liner to cement the liner to the well bore;

(d) providing said seal assembly with releasable lock means for maintaining said seal assembly fixed relative to at least one of said setting tool and liner, said lock means releasing said seal assembly for axial movement relative to said setting tool and liner in a first sense in response to fluid pressure differential acting on said seal assembly in said first axial direction sense to communicate fluid along the region between the liner and the setting tool, and (e) removing the setting tool and the seal assembly.

19. A method as defined in claim 18 further comprising the additional step of resetting the seal assembly to seal the setting tool to the liner after the pressure differential has been reduced.

20. Apparatus for sealing between two concentric annular surfaces comprising:

(a) a generally tubular seal body for positioning between such two annular surfaces;

(b) first annular seal means carried by said seal body for sealing engagement with the outer annular surface;

(c) second annular seal means carried by said seal body for sealing engagement with the inner annular surface;

(d) releasable lock means for maintaining said seal body fixed relative to at least one of said annular surfaces, said lock means releasing said seal body for axial movement relative to said annular surface in a first sense in response to fluid pressure differential acting on said first and second seal means in said first axial direction sense;

(e) elastic means for biasing said seal body in the opposite sense along said axial direction whereby, the said pressure differential which has moved said seal body in said first axial direction sense is relieved, said elastic means may move said seal body in the opposite axial direction sense;

(f) wherein when said seal body is so moved in said first axial direction sense, at least one of said first or second seal means is disengaged from sealing engagement with the corresponding outer or inner annular surface, respectively; and (g) said disengaged seal means may sealingly engage the corresponding annular surface upon movement of said seal body in the opposite axial direction sense by said elastic means.

21. Apparatus for sealing between two concentric annular surfaces comprising:

(a) a generally tubular seal body for positioning between such two annular surfaces;

(b) first annular seal means carried by said seal body for sealing engagement with the outer annular surface;

(c) second annular seal means carried by said seal body for sealing engagement with the inner annular surface;

(d) releasable lock means for maintaining said seal body fixed relative to at least one of said annular surfaces, said lock means releasing said seal body for axial movement relative to said annular surface in a first sense in response to fluid pressure differential acting on said first and second seal means in said first axial direction sense;

(e) elastic means for biasing said seal body in the opposite sense along said axial direction whereby, when said pressure differential which has moved said seal body in said first axial direction sense is relieved, said elastic means may move said seal body in the opposite axial direction sense; and (f) wherein said releasable lock means comprises frangible means for anchoring said seal body fixed relative to at least one of said annular surfaces, said frangible means releasing on application of a predetermined pressure differential acting on said first and second seal means on said first axial direction sense.

22. Apparatus for sealing between two concentric annular surfaces comprising:

(a) a generally tubular seal body for positioning between such two annular surfaces;

(b) first annular seal means carried by said seal body for sealing engagement with the outer annular surfae;

(c) second annular seal means carried by said seal body for sealing engagement with the inner annular surface;

(d) releasable lock means for maintaining said seal body fixed relative to said at least one of said annular surfaces, said lock means releasing said seal body for axial movement relative to said annular surface in a first sense in response to fluid pressure differential acting on said first and second seal means in said first axial direction sense; and (e) elastic means for biasing said seal body in the opposite sense along said axial direction whereby, when said pressure differential which has moved said seal body in said first axial direction sense is relieved, said elastic means may move said seal body in the opposite axial direction sense; and (f) wherein said elastic means comprises spring means, whereby movement of said seal body in said first axial direction sense strains said spring means.

* * * * *